US009727019B2

(12) United States Patent
Tanaka

(10) Patent No.: US 9,727,019 B2
(45) Date of Patent: Aug. 8, 2017

(54) IMAGE FORMING APPARATUS AND IMAGE FORMING SYSTEM

(71) Applicant: KONICA MINOLTA, INC., Chiyoda-ku, Tokyo (JP)

(72) Inventor: Yu Tanaka, Hachioji (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 14/710,540

(22) Filed: May 12, 2015

(65) Prior Publication Data

US 2015/0338815 A1 Nov. 26, 2015

(30) Foreign Application Priority Data

May 20, 2014 (JP) ..... 2014-104692

(51) Int. Cl.
*G03G 15/00* (2006.01)
*G03G 15/20* (2006.01)
(Continued)

(52) U.S. Cl.
CPC ..... *G03G 15/70* (2013.01); *G03G 15/20* (2013.01); *G03G 15/2075* (2013.01);
(Continued)

(58) Field of Classification Search
CPC ..... G03G 2215/00552; G03G 2215/00531; G03G 2215/00708; G03G 2221/00;
(Continued)

(56) References Cited

U.S. PATENT DOCUMENTS

| | | | | |
|---|---|---|---|---|
| 4,511,241 | A * | 4/1985 | Tsudaka et al. | 399/19 |
| 2011/0135325 | A1 | 6/2011 | Hitaka et al. | |
| 2015/0098715 | A1* | 4/2015 | Sakurai | 399/18 |

FOREIGN PATENT DOCUMENTS

| | | | |
|---|---|---|---|
| JP | 58095757 | A | 6/1983 |
| JP | 01122855 | A | 5/1989 |

(Continued)

OTHER PUBLICATIONS

Japanese Office Action dated Aug. 23, 2016 (and English translation thereof) issued in counterpart Japanese Application No. 2014-104692.

*Primary Examiner* — R. A. Smith
*Assistant Examiner* — John M Royston
(74) *Attorney, Agent, or Firm* — Holtz, Holtz & Volek PC

(57) ABSTRACT

An image forming apparatus according to the present invention includes a control unit 111 which performs white paper cleaning by making remaining papers pass through a fixing device in automatic purge of conveying and discharging the remaining papers after an originating paper having caused a jam is removed when the jam has occurred in a paper conveyance path, and display units 115 and 111 which display the number of papers, which is obtained by subtracting the number of the papers having passed through the fixing device by the control unit for the white paper cleaning in the automatic purge from the set number of papers set in advance as the number of papers required to pass through the fixing device in the white paper cleaning, as the number of papers set for white paper cleaning after the automatic purge.

14 Claims, 11 Drawing Sheets

(51) Int. Cl.
*G03G 21/00* (2006.01)
*G03G 21/02* (2006.01)

(52) U.S. Cl.
CPC ..... *G03G 15/5012* (2013.01); *G03G 21/00* (2013.01); *G03G 21/02* (2013.01); *G03G 2215/00531* (2013.01); *G03G 2215/00552* (2013.01); *G03G 2215/00708* (2013.01); *G03G 2221/00* (2013.01)

(58) Field of Classification Search
CPC .... G03G 21/02; G03G 21/00; G03G 15/2075; G03G 15/5012
See application file for complete search history.

(56) References Cited

FOREIGN PATENT DOCUMENTS

| | | | |
|---|---|---|---|
| JP | 07098556 | A | 4/1995 |
| JP | 2005234442 | A | 9/2005 |
| JP | 2006011146 | A | 1/2006 |
| JP | 2011123153 | A | 6/2011 |

* cited by examiner

IMAGE FORMING APPARATUS AND IMAGE FORMING SYSTEM

CROSS-REFERENCE TO RELATED APPLICATION

This application is based on Japanese Patent Application No. 2014-104692 filed on May 20, 2014, the contents of which are incorporated herein by reference.

BACKGROUND

1. Technical Field

The present invention relates to an image forming apparatus and an image forming system.

2. Description of Related Art

Conventionally, in the image forming apparatus, when a jam such as a paper jam occurs, after the conveyance of papers is stopped and remaining papers remaining in a conveyance path are removed, white paper cleaning is performed by which toner remaining in a fixing device or the like due to adhesion of unfixed toner on remaining papers is removed by feeding a blank paper and making the blank paper pass through the fixing device.

In normal white paper cleaning, since the blank paper is fed after all remaining papers including an originating paper of the jam are removed at the time of the occurrence of the jam, the remaining papers are wasted, and effort is required to reset the remaining papers to a tray for reusing in the white paper cleaning.

As a conventional technology for solving the problems in such white paper cleaning, there is the technology disclosed in Unexamined Japanese Patent Publication No. 2005-234442. That is, at the time of the occurrence of the jam, in automatic purge of discharging the remaining papers other than the originating paper of the jam after the originating paper is removed, the white paper cleaning is performed by making the remaining papers pass through the fixing device. In this way, it is possible to prevent the waste of the remaining papers in the white paper cleaning and reset for reusing the remaining papers is not necessary.

SUMMARY

However, the conventional technology has a problem that, when the removal of toner remaining in the apparatus is not sufficient only by the white paper cleaning in the automatic purge, if the white paper cleaning after the automatic purge is further performed in the number of papers which is a default value set in advance as the number of papers for the white paper cleaning, the waste of the papers occurs according to the number of remaining papers used in the white paper cleaning in the automatic purge.

The present invention has been made to solve the problems described above. That is, the number of the remaining papers used in the white paper cleaning in the automatic purge is subtracted from a default value set in advance as the number of the papers by which the white paper cleaning is performed, and the number of the papers after the subtraction is displayed as the number of papers set for the white paper cleaning after the automatic purge. In this way, the number of papers to be used in the white paper cleaning after the automatic purge is optimized in response to the number of remaining papers at the time of the occurrence of the jam, so that it is possible to prevent the waste of the papers. Furthermore, after the degree of pollution of the papers used in the white paper cleaning in the automatic purge and discharged is recognized, it is possible to determine the necessity of the white paper cleaning after the automatic purge and the number of the papers to be used in the white paper cleaning after the automatic purge, so that it is possible to further improve the effect of preventing the waste of the papers.

To achieve at least one of the abovementioned objects, the image forming apparatus and the image forming system reflecting one aspect of the present invention includes the followings.

(1) An image forming apparatus comprising: a control unit which performs white paper cleaning by making remaining papers pass through a fixing device in automatic purge of conveying and discharging the remaining papers after an originating paper having caused a jam is removed when the jam has occurred in a paper conveyance path; and a display unit which displays a number of papers, which is obtained by subtracting a number of the papers having passed through the fixing device by the control unit for the white paper cleaning in the automatic purge from a set number of the papers set in advance as a number of the papers required to pass through the fixing device in the white paper cleaning, as a number of the papers set for white paper cleaning after the automatic purge.

(2) The image forming apparatus as described in above (1), wherein the display unit displays the number of the papers, which is obtained by subtracting a number of the papers, which is obtained by excluding a number of the papers having passed through the fixing device after being subjected to image transfer from the number of the papers having passed through the fixing device by the control unit for the white paper cleaning in the automatic purge, from the set number of the papers, as the number of the papers set for the white paper cleaning after the automatic purge.

(3) The image forming apparatus as described in above (1), wherein the display unit further performs display for prompting confirmation for the paper discharged by the automatic purge.

(4) The image forming apparatus as described in above (1), wherein, when the number of the papers having passed through the fixing device by the control unit for the white paper cleaning in the automatic purge has exceeded the set number of the papers, the display unit does not display the number of the papers after the subtraction.

(5) The image forming apparatus as described in above (1), wherein the control unit discharges, to a dedicated tray, only a paper having passed through the fixing device without being subjected to image transfer among the papers having passed through the fixing device for the white paper cleaning in the automatic purge.

The objects, features, and characteristics of this invention other than those set forth above will become apparent from the description given herein below with reference to preferred embodiments illustrated in the accompanying drawings.

DETAILED DESCRIPTION

Hereinafter, an image forming apparatus and an image forming system according to an embodiment of the present invention will be described in detail with reference to the accompanying drawings.

Figure 1:
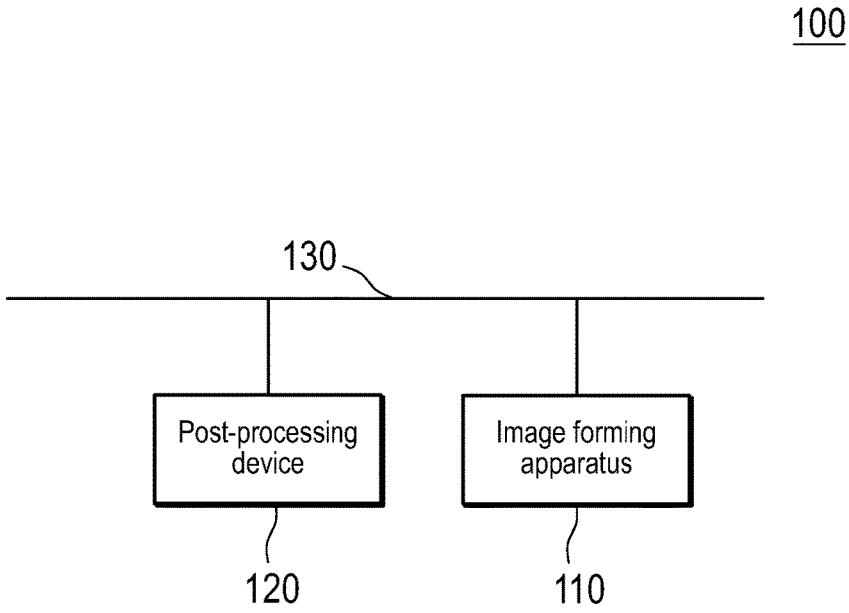
FIG. 1 is a block diagram of an image forming system according to an embodiment of the present invention.

FIG. 1 is a block diagram of the image forming system according to the embodiment of the present invention.

As illustrated in FIG. 1, the image forming system 100 includes the image forming apparatus 110 and a post-processing device 120.

The image forming apparatus 110 and the post-processing device 120 are communicably connected to each other via a network 130. The network 130 can be configured by a LAN (Local Area Network) connecting a computer and network devices to one another based on a standard such as the Ethernet (a registered trademark) and FDDI (Fiber-Distributed Data Interface).

Figure 2:
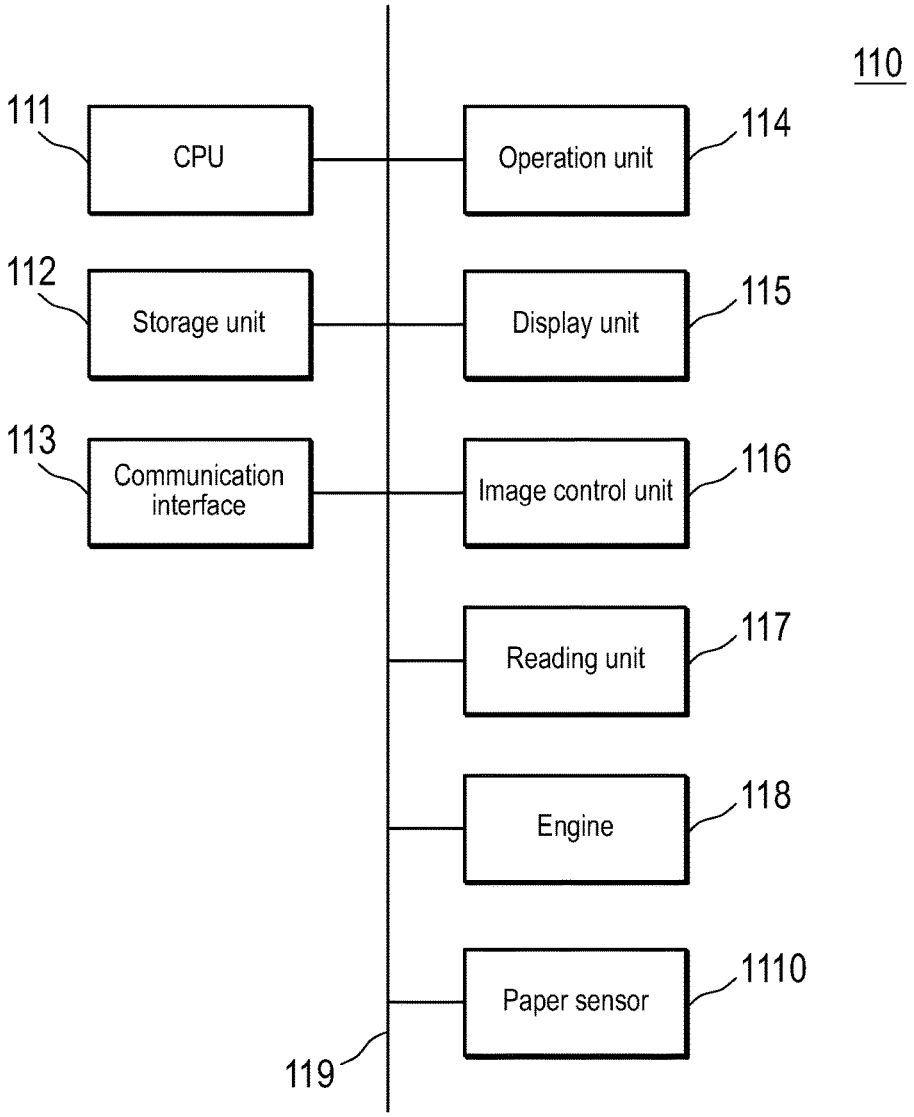
FIG. 2 is a block diagram illustrating a configuration of an image forming apparatus according to the embodiment of the present invention.

FIG. 2 is a block diagram illustrating a configuration of the image forming apparatus.

As illustrated in FIG. 2, the image forming apparatus 110 includes a CPU (Central Processing Unit) 111, a storage unit 112, a communication interface 113, an operation unit 114, a display unit 115, an image control unit 116, a reading unit 117, an engine 118, and a paper sensor 1110. These elements are connected to one another via a bus 119 for exchanging signals.

The storage unit 112 can be configured by RAM (Random Access Memory), ROM (Read Only Memory), and HDD (Hard Disk Drive). The RAM temporarily stores a program executed by the CPU 111 or data processed by the CPU 111. The ROM stores various programs or various kinds of data. The HDD stores various programs including a program for controlling each element of the image forming apparatus 110 by the CPU 111, image data received through the communication interface 113 or the reading unit 117, and other various kinds of data.

The communication interface 113 is an interface for performing communication between the image forming apparatus 110 and an external device, and various local connection interfaces such as a network interface based on a standard including the Ethernet (a registered trademark), SATA, PCI, Express, USB, and IEEE 1394, or a wireless communication interface including the Bluetooth (a registered trademark) and IEEE 802.11 are used.

The operation unit 114 includes a touchpanel for performing various types of setting, and various fixed keys such as a numeric keypad for setting the number of copies or the like, a start key for instructing the start of an operation, a stop key for instructing the stop of an operation, and a reset key for initializing various setting conditions.

The display unit 115 includes a touchpanel for displaying various types of information and inputting various types of setting, various fixed keys such as a numeric keypad for setting the number of copies or the like, a start key for instructing the start of an operation, a stop key for instructing the stop of an operation, and a reset key for initializing various setting conditions, a display lamp, or the like. Overlapping functions of the operation unit 114 and the display unit 115 may be included in any one of the operation unit 114 and the display unit 115.

The image control unit 116 performs a layout process and a rasterization process of print data included in a print job received by the communication interface 113, and generates image data which is data of a bitmap type image. The print job is a generic term of a print command for the image forming apparatus 110 and includes print data and print setting. The print data is data of a document to be printed, and for example, may include various kinds of data such as image data, vector data, and text data. In detail, the print data may be PDL (Page Description Language) data, PDF (Portable Document Format) data, or TIFF (Tagged Image File Format) data. The print setting is setting regarding image formation to a paper and post-processing of a printed matter, and for example, may include various types of setting such as a paper type, a grayscale or a full color, 2in1, duplex printing, stapling, punching, and folding.

The reading unit 117 irradiates a document, which has been set in a predetermined reading position of a document platen, by using a light source such as a fluorescent lamp, photoelectrically converts reflected light into an electrical signal by using an imaging device such as a CCD (Charge Coupled Device) image sensor, and generates image data from the electrical signal.

The engine 118 performs image formation based on the image data on the paper through each process of charging, exposure, development, transfer, and fixing by an electrophotographic scheme, and then outputs the paper.

The paper sensor 1110 detects positions of the papers in a conveyance path. The paper sensor 1110, for example, can be configured by a line sensor provided at a required place of the conveyance path.

The CPU 111 constitutes a control unit, and constitutes a display unit together with the display unit 115.

The CPU 111 performs the control of the aforementioned each element, various arithmetic processes or the like according to the program. Specifically, the CPU 111 performs general control regarding various processes, image formation, and storing while cooperating with each element constituting the image forming apparatus 110. Furthermore, the CPU 111 communicates with the post-processing device 120, thereby transmitting data for controlling the post-processing device 120 to the post-processing device 120 and receiving data or the like regarding a post-processing state from the post-processing device 120 according to necessity.

The CPU 111 detects the paper jam having occurred in the image forming apparatus 110 based on the positions of the papers in the conveyance path detected by the paper sensor 1110. For example, the CPU 111 can detect the jam by no change in the positions of the papers even though control for conveying the papers is performed.

The CPU 111 detects the occurrence of the jam in the post-processing device 120 by receiving information on the jam having occurred in the post-processing device 120 from the post-processing device 120 which is a device, except for the image forming apparatus 110 of the image forming system 100. When the jam has occurred in the image forming apparatus 110 or the post-processing device 120, the CPU 111 continues the conveyance of the paper positioned at a downstream side of the conveyance path from an originating paper of the jam, completes image forming processing and post-processing on the paper similarly to normal times, and outputs the paper from the image forming system 100. The CPU 111 temporarily stops the conveyance of the originating paper of the jam and the paper positioned at an upstream side of the conveyance path from the originating paper of the jam.

The CPU 111 displays the position of the originating paper of the jam on the display unit 115 together with display for prompting the removal of the originating paper.

After the originating paper of the jam is removed by a user, the CPU 111 performs automatic purge by which remaining papers, other than the originating paper, remaining in the conveyance path are conveyed and are discharged from the image forming apparatus 110, and are further discharged from the post-processing device 120. In the automatic purge, the CPU 111 performs white paper cleaning which uses the remaining papers by making the remaining papers pass through a fixing device of the engine 118 so as to be heated and pressed by the fixing device.

On the basis of the positions of the remaining papers detected by the paper sensor 1110, the CPU 111 calculates the number of the remaining papers having passed through the fixing device for the white paper cleaning in the automatic purge. The CPU 111 subtracts the number of the papers having passed through the fixing device for the white paper cleaning in the automatic purge from a default value which is the set number of papers set in advance as the number of the papers required to pass through the fixing device in the white paper cleaning, and displays the number of the papers after the subtraction on the display unit 115 as the number of the papers set for the white paper cleaning after the automatic purge.

Figure 3:
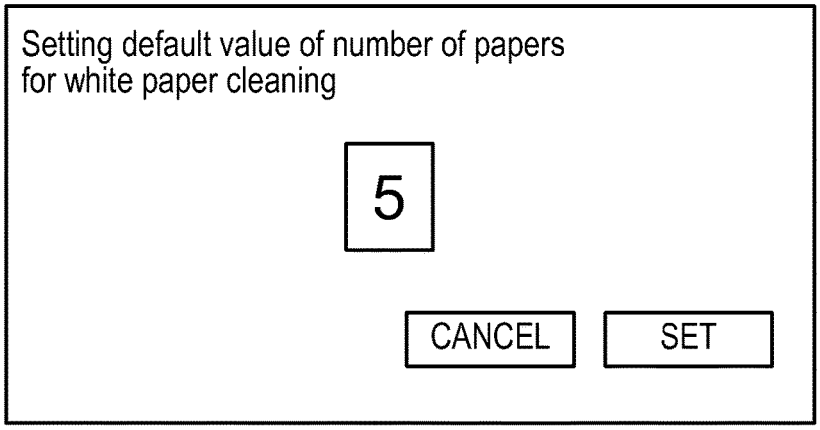
FIG. 3 is a diagram illustrating a setting screen for setting a default value of the number of the papers to be used in white paper cleaning.

FIG. 3 is a diagram illustrating a setting screen for setting a default value of the number of the papers to be used in the white paper cleaning.

A user can set the default value of the number of papers to be used in the white paper cleaning, which is the number of papers required to pass through the fixing device in the white paper cleaning, on the present screen.

In the example of FIG. 3, "5" is input as the default value and a button "SET" is selected in this state, so that "5" is set as the default value. In addition, when a button "CANCEL" is selected, the default value is not set.

Since the number of the papers required to pass through the fixing device in the white paper cleaning differs according to a toner adhesion amount in the fixing device 14 or the like, the degree of the jam, and a jam processing method, it is not possible to indiscriminately decide the number of papers. However, the basic number of the papers is set as the default value in advance. In addition, it is possible to change the default value at an arbitrary timing.

Figure 4:
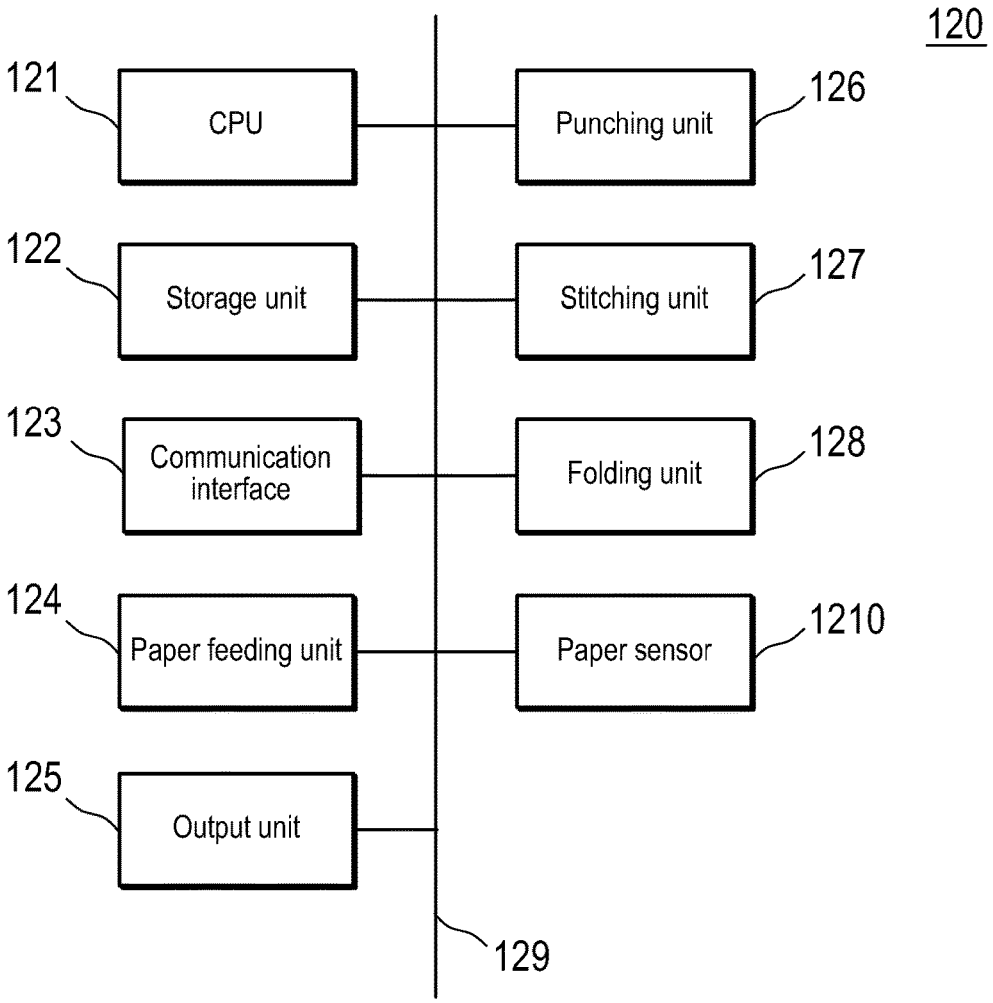
FIG. 4 is a block diagram illustrating a configuration of a post-processing device.

FIG. 4 is a block diagram illustrating a configuration of the post-processing device.

The post-processing device 120 includes a CPU 121, a storage unit 122, a communication interface 123, a paper feeding unit 124, an output unit 125, a punching unit 126, a stitching unit 127, a folding unit 128, and a paper sensor 1210. These elements are connected to one another via a bus 129 for exchanging signals.

The storage unit 122 stores a program for controlling each element of the post-processing device 120 by the CPU 121, and various kinds of data such as print setting received through the communication interface 123. The storage unit 122, for example, can be configured by RAM and HDD.

The communication interface 123 is an interface for performing communication between the post-processing device 120 and the image forming apparatus 110, and the Ethernet or the like is used.

The paper feeding unit 124 receives the papers on which image formation has been performed by the image forming apparatus 110.

The output unit 125 outputs the papers subjected to post-processing as the printed matters.

The punching unit 126 perforates a punch hole in the paper based on the print setting.

The stitching unit 127 has a side stitching unit for performing side stitching and a saddle stitching unit for performing saddle stitching, and performs the side stitching or the saddle stitching on the papers based on the print setting.

The folding unit 128 doubly or triply folds the paper based on the print setting.

The paper sensor 1210 detects positions of the papers in the conveyance path. The paper sensor 1210, for example, can be configured by a line sensor provided at a required place of the conveyance path.

The CPU 121 performs the control of the aforementioned each element, various arithmetic processes or the like according to the program. The CPU 121 controls the punching unit 126, the stitching unit 127, and the folding unit 128 constituting the post-processing device 120 to perform post-processing of the paper.

The CPU 121 detects the jam having occurred in the post-processing device 120 based on the positions of the papers in the conveyance path detected by the paper sensor 1210. For example, the CPU 121 can detect the jam by no change in the positions of the papers even though control for conveying the papers is performed.

The CPU 121 communicates with the image forming apparatus 110, thereby transmitting information on the jam having occurred in the post-processing device 120 to the image forming system 100. The CPU 121 continues the conveyance of the paper positioned at the downstream side of the conveyance path from the originating paper of the jam, completes the post-processing on the paper similarly to normal times, and outputs the paper. The CPU 121 temporarily stops the conveyance of the originating paper of the jam and the paper positioned at the upstream side of the conveyance path from the originating paper of the jam, and discharges the paper in the automatic purge performed after the originating paper of the jam is removed by the user.

Figure 5:
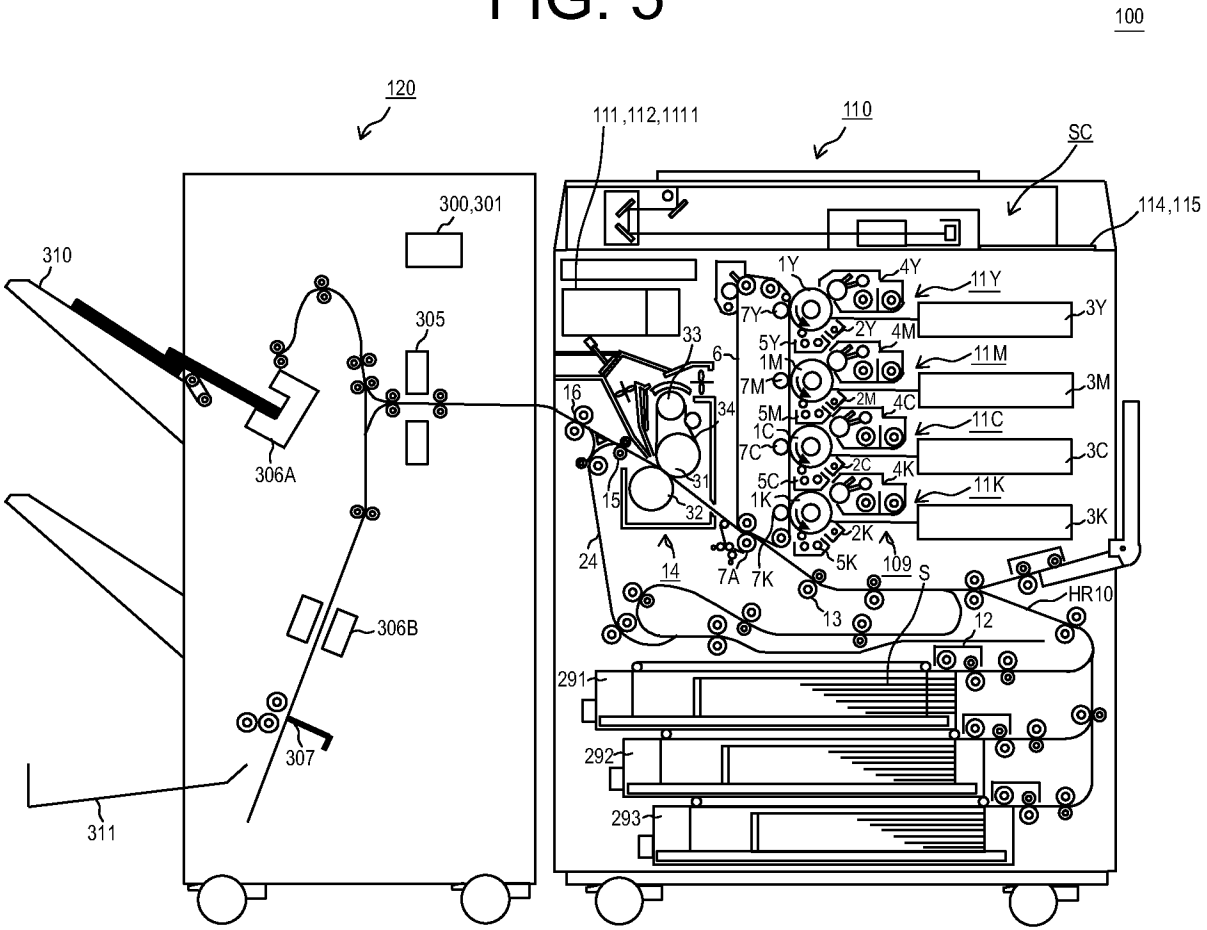
FIG. 5 is an entire configuration diagram of the image forming system according to the embodiment of the present invention.

FIG. 5 is an entire configuration diagram of the image forming system according to the present embodiment.

As described above, the image forming system 100 includes the image forming apparatus 110 and the post-processing device 120, and is configured by connecting these devices to each other. Papers S are subjected to the image formation by the image forming apparatus 110 and then are subjected to the post-processing by the post-processing device 120.

The image forming apparatus 110 is called a tandem type color image forming apparatus, it performs the color image formation by four image forming units.

The image is scanned and exposed to a document placed on a document platen by an optical system of a scanning exposure device of an image reading device SC and is read by a line image sensor, and then a photoelectrically converted image information signal is subjected to analog processing, A/D conversion, shading correction, image compression processing or the like in an image forming unit 1111 and is input to an optical writing unit of the image forming unit.

The four image forming units are an image forming unit 11Y for forming a yellow (Y) image, an image forming unit 11M for forming a magenta (M) image, an image forming unit 11C for forming a cyan (C) image, and an image forming unit 11K for forming a black (K) image, and marks Y, M, C, and K indicating colors to be formed are added next to numerals 11 common to the image forming units.

The image forming unit 11Y includes a photosensitive drum 1Y and a charging unit 2Y, an optical writing unit 3Y, a developing device 4Y, and a drum cleaner 5Y arranged around the photosensitive drum 1Y.

Similarly, the image forming unit 11M includes a photosensitive drum 1M and a charging unit 2M, an optical writing unit 3M, a developing device 4M, and a drum cleaner 5M arranged around the photosensitive drum 1M, the image forming unit 11C includes a photosensitive drum 1C and a charging unit 2C, an optical writing unit 3C, a developing device 4C, and a drum cleaner 5C arranged around the photosensitive drum 1C, and the image forming unit 11K includes a photosensitive drum 1K and a charging unit 2K, an optical writing unit 3K, a developing device 4K, and a drum cleaner 5K arranged around the photosensitive drum 1K.

In the image forming units 11Y, 11M, 11C, and 11K, the respective photosensitive drums 1Y, 1M, 1C, and 1K, the respective charging units 2Y, 2M, 2C, and 2K, the respective optical writing units 3Y, 3M, 3C, and 3K, the respective developing devices 4Y, 4M, 4C, and 4K, and the respective drum cleaners 5Y, 5M, 5C, and 5K are elements having common contents, respectively.

The image forming units 11Y, 11M, 11C, and 11K respectively write image information signals in the photosensitive drums 1Y, 1M, 1C, and 1K by the optical writing units 3Y, 3M, 3C, and 3K, and form latent images based on the image information signals on the photosensitive drums 1Y, 1M, 1C, and 1K, respectively. Then, the latent images are developed by the developing devices 4Y, 4M, 4C, and 4K, and toner images are formed on the photosensitive drums 1Y, 1M, 1C, and 1K as visible images.

The images of a yellow (Y) color, a magenta (M) color, a cyan (C) color, and a black (K) color are respectively formed in the photosensitive drums 1Y, 1M, 1C, and 1K of the image forming units 11Y, 11M, 11C, and 11K.

An intermediate transfer belt 6 is wound around a plurality of rollers and is supported to be able to be traveled.

The toner images of each color formed by the image forming units 11Y, 11M, 11C, and 11K are sequentially transferred on the travelling intermediate transfer belt 6 by primary transfer units 7Y, 7M, 7C, and 7K, resulting in the formation of the toner image which is a toner color image in which color layers of Y (yellow), M (magenta), C (cyan), and K (black) have been superimposed.

A paper conveyance unit HR10 conveys the papers S. The papers S are accommodated in paper feeding trays 291, 292, and 293, are fed by a first paper feeding unit 12, and are conveyed to a secondary transfer unit 7A via a resist roller 13, so that the toner image on the intermediate transfer belt 6 is transferred to the papers S. The secondary transfer unit 7A is an example of a transfer means and transfers the toner image to the papers S and conveys the papers S.

The papers S on which the toner image are transferred are subjected to heat and pressure by the fixing device 14, so that the toner image on the papers S is fixed. Then, the papers S subjected to image formation by the transfer and fixing of the toner image are discharged to outside of the apparatus via a fixing conveyance roller 15 and a paper feeding roller 16.

The fixing device 14 includes a fixing roller 31, a pressing roller 32, a heating roller 33, and a fixing belt 34. The fixing roller 31 is pressed by the pressing roller 32 to form a nip area having an approximately arc shape so that a side of the paper S with the toner image placed thereon becomes convex. In the nip area, the paper S is interposed with the fixing belt 34 heated via the heating roller 33. Then, toner of the toner image adhered on the paper S is heated and pressed, so that the toner image is fixed to the paper S. The fixing device 14 is an example of a fixing means, and fixes the toner image, which has been transferred to the paper S by the secondary transfer unit 7A, to the paper S, and conveys the paper S.

The image forming apparatus 110 includes a paper reversing unit 24, and can lead the paper S subjected to the fixing from the fixing conveyance roller 15 to the paper reversing unit 24 so as to reverse the front and the back of the paper S for discharge, or can perform image formation on both surfaces of the paper S.

It is possible to set the size, the number or the like of the papers S when the image formation is performed from the operation unit 114 which is installed at an upper portion of the body of the image forming apparatus 110. Moreover, it is possible to set a paper type and various paper feeding conditions from the operation unit 114.

On the display unit 115, the size, the number or the like of the papers S set in the operation unit 114 are displayed. Moreover, on the display unit 115, when the paper jam has occurred, the position of the originating paper of the jam is displayed together with display for prompting the removal of the originating paper. Then, after the originating paper is removed and automatic purge is performed, the number of papers, which is obtained by subtracting the number of papers having passed through the fixing device for the white paper cleaning in the automatic purge from the default value set as the number of papers required to pass through the fixing device 14 in the white paper cleaning, is displayed as the number of papers set for the white paper cleaning after the automatic purge.

The operations of the aforementioned each element for the image formation and the operations of each element for conveying the papers S are controlled by the CPU 111. The CPU 111 performs the control of the aforementioned each element and various arithmetic processes.

Figure 6:
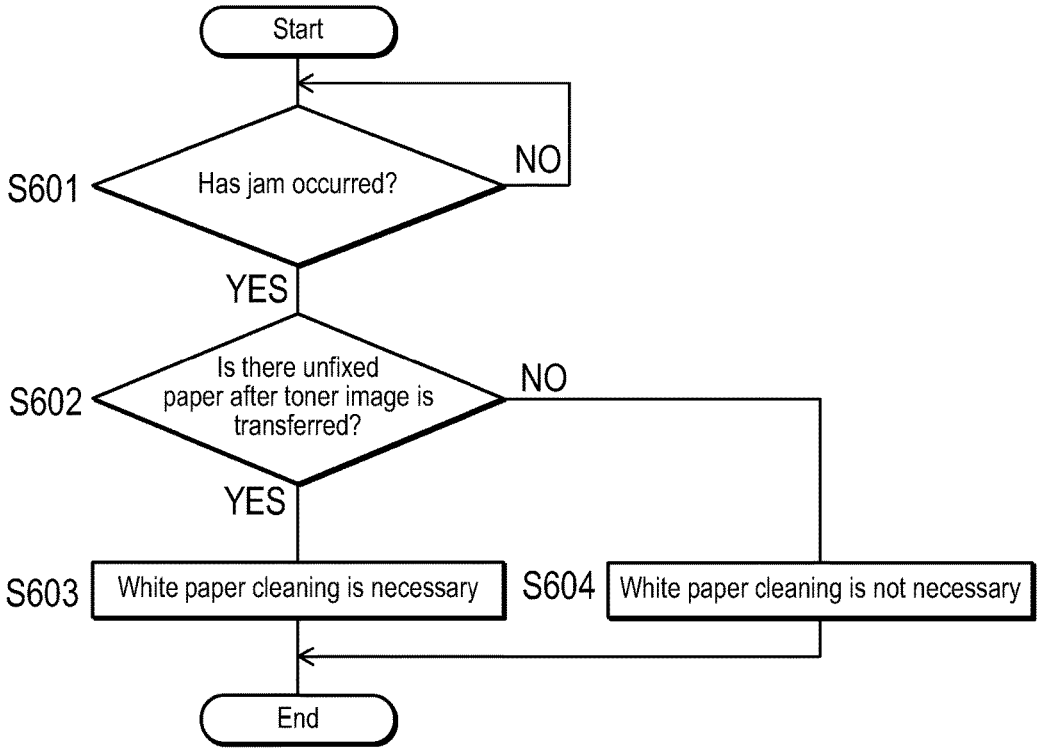
FIG. 6 is a flowchart illustrating a process of determining the necessity of the white paper cleaning when jam has occurred in the image forming system.

FIG. 6 is a flowchart illustrating a process of determining the necessity of the white paper cleaning when the jam has occurred in the image forming system.

The present flowchart can be performed by the CPU 111 according to the program stored in the storage unit of the image forming apparatus 110.

The CPU 111 detects whether the jam has occurred in the image forming apparatus 110 or the post-processing device 120 (S601).

When it is detected that the jam has occurred in the image forming apparatus 110 or the post-processing device 120 (S601: YES), the CPU 111 determines whether there is an unfixed paper not subjected to toner image fixing by the fixing device 14 after the toner image is transferred by the intermediate transfer belt 6 (S602). The CPU 111 can determine that there is the unfixed paper not subjected to the fixing after the toner image transfer when the paper is detected by the paper sensor 1110 from a position in which the toner image is transferred by the intermediate transfer belt 6 to a position in which the toner image is heated and pressed by the fixing device 14.

When it is determined that there is the unfixed paper not subjected to the fixing after the toner image transfer (S602: YES), the CPU 111 determines that white paper cleaning is necessary (S603). The reason for determining that the white paper cleaning is necessary when there is at least one unfixed paper not subjected to the fixing after the toner image transfer, is as follows. That is, if the paper is temporarily stopped in the vicinity of the fixing device 14 when the jam has occurred, it is highly probable that the fixing device 14 and the periphery of the fixing device 14 are polluted by unfixed toner. Furthermore, this is because when the paper has been removed by the user, the unfixed toner is overflown into the apparatus, so that the apparatus may be polluted.

When it is determined that there is no unfixed paper not subjected to the fixing after the toner image transfer (S602: NO), the CPU 111 determines that the white paper cleaning is not necessary (S604). Before the toner image is transferred, for example, since it is possible to clean toner adhered to the photosensitive drums 1Y, 1M, 1C, and 1K by photosensitive blades and to clean toner by applying a cleaning bias in the transfer of the toner image, it is not necessary to perform the white paper cleaning.

Figure 7:
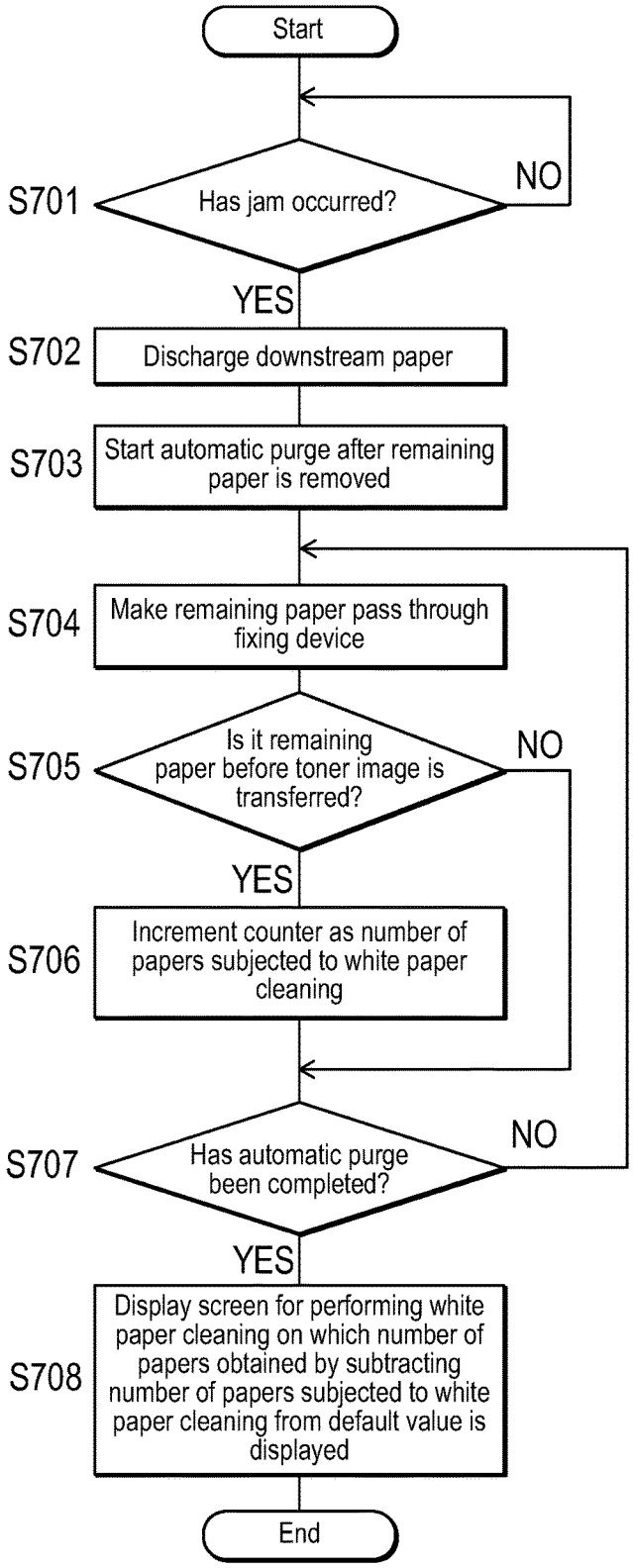
FIG. 7 is a flowchart illustrating a process of the white paper cleaning which is performed at the time of automatic purge in the image forming system.

FIG. 7 is a flowchart illustrating a process of the white paper cleaning which is performed at the time of the automatic purge in the image forming system. The present flowchart is performed when it is determined that the white paper cleaning is necessary in the flowchart of FIG. 6.

The present flowchart can be performed by the CPU 111 according to the program stored in the storage unit of the image forming apparatus 110.

When CPU 111 detects that the jam has occurred in the image forming apparatus 110 or the post-processing device 120 (S701: YES), the CPU 111 discharges the paper (hereinafter, referred to as a "downstream paper") in the image forming apparatus 110 and the post-processing device 120, which is positioned at the downstream side from the originating paper (S702). Simultaneously, the CPU 111 temporarily stops the conveyance of the originating paper and the paper in the image forming apparatus 110 and the post-processing device 120, which is positioned at an upstream side from the originating paper.

Figure 8:
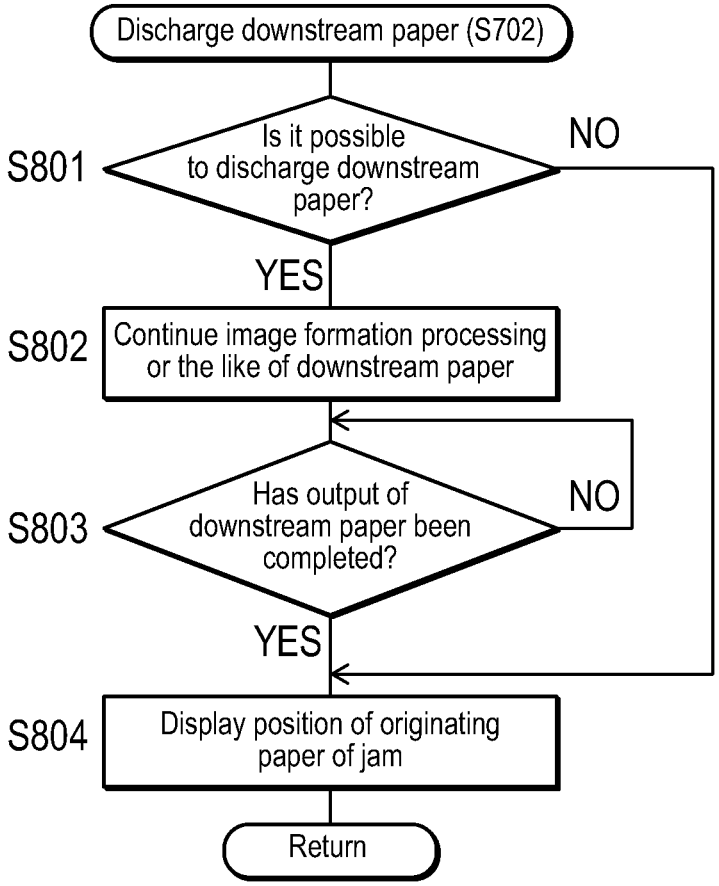
FIG. 8 is a sub-routine flowchart of step S702 of FIG. 7.

FIG. 8 is a sub-routine flowchart of step S702 of FIG. 7.

The CPU 111 determines whether it is possible to discharge the downstream paper from the image forming system 100 (S801). The case in which the discharge of the downstream paper is not possible, for example, is the case in which the jam has doubly occurred due to the occurrence of the jam in the downstream paper.

When it is determined that it is possible to discharge the downstream paper from the image forming system 100 (S801: YES), the CPU 111 continues the image formation process of the downstream paper and makes the post-processing device 120 perform the post-processing (S802). When the occurrence reason of the jam, for example, is not a dangerous operation by the user such as the opening a door of the image forming apparatus 110 during the image formation process, the normal image formation process and the post-processing are continued for the downstream paper, so that the downstream paper is normally output as the printed matter subjected to the image formation process and the post-processing.

When the output of all downstream papers from the image forming system 100 has been completed (S803: YES), the CPU 111 displays the position of the originating paper of the jam on the display unit 115 together with display for prompting the removal of the originating paper (S804). Furthermore, the CPU 111 stops the heating function of the fixing device 14.

Figure 9:
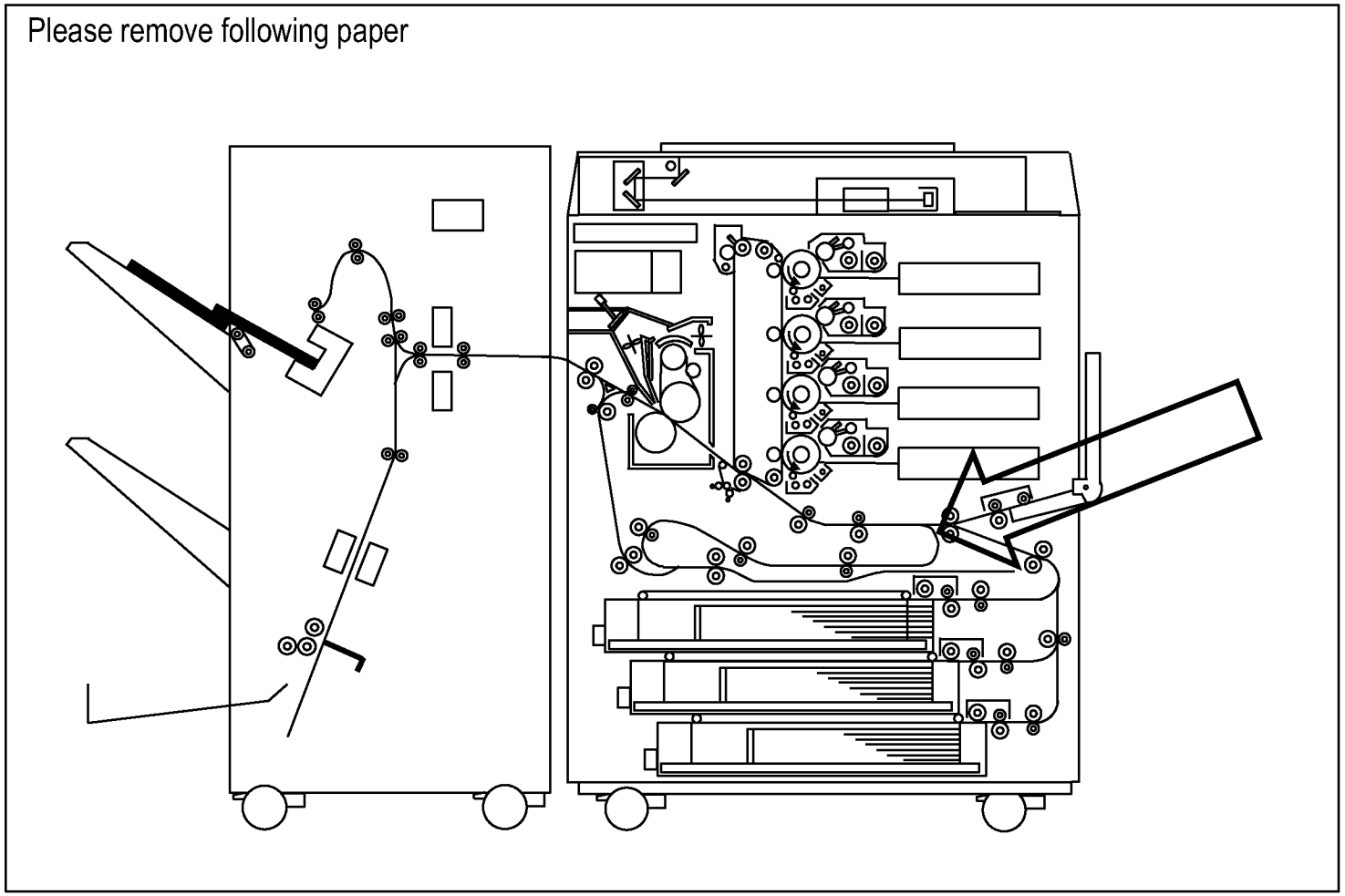
FIG. 9 is a diagram illustrating a display screen displayed on a display unit on which the position of an originating paper of the jam is displayed together with display for prompting the removal of the originating paper.

FIG. 9 is a diagram illustrating a display screen displayed on the display unit on which the position of the originating paper of the jam is displayed together with the display for prompting the removal of the originating paper.

As illustrated in FIG. 9, the position of the originating paper of the jam is indicated by an arrow, and display "please remove the following paper" in order to prompt the removal of the originating paper.

The user can grasp the position of the originating paper of the jam by confirming the display screen illustrated in FIG. 7 through the display unit 115, and remove the originating paper from the position indicated by the arrow.

In addition, only the position of the originating paper of the jam is displayed on the display unit 115 together with the display for prompting the removal of the originating paper. However, even when the remaining papers other than the originating paper of the jam have been removed by the user, the number of remaining papers in the image forming system 100 can be detected by the CPU 111 based on the positions of the papers detected by the paper sensor 1110.

Returning to FIG. 7, after the removal of the originating paper of the jam by the user is detected by the paper sensor 1110, the CPU 111 performs warm-up of the pressure fixing device 14 having stopped heating, and starts automatic purge (S703).

At the time of the automatic purge, the CPU 111 performs the white paper cleaning by making the remaining paper remaining in the conveyance path of the image forming apparatus 110 pass through the fixing device 14 so as to be heated and pressed (S704).

The CPU 111 determines whether the remaining paper subjected to the white paper cleaning by passing through the fixing device 14 in the automatic purge is an untransferred remaining paper before the toner image is transferred by the intermediate transfer belt 6 (S705). Whether the remaining paper is the untransferred remaining paper before the toner image transfer is determined based on the position of the remaining paper when conveyance has been temporarily stopped by the detection of the occurrence of the jam in step S701. Specifically, when the position of the remaining paper is the upstream side from a position in which the toner image is transferred by the intermediate transfer belt 6, the remaining paper is determined as the untransferred remaining paper before the toner image transfer.

When the remaining paper subjected to the white paper cleaning by passing through the fixing device 14 in the automatic purge is the untransferred remaining paper (S705: YES), the CPU 111 increments an internal counter (S706). In this way, the number of the papers having passed through the fixing device 14 for the white paper cleaning in the automatic purge is counted.

On the other hand, when the remaining paper subjected to the white paper cleaning by passing through the fixing device 14 in the automatic purge is the remaining paper having passed through the fixing device 14 after the transfer of the toner image is performed (S705: NO), the CPU 111 does not increment the internal counter. That is, the remaining paper is excluded from the number of the papers subjected to the white paper cleaning by passing through the fixing device 14 and is not counted. Since the remaining paper with the transferred toner image includes a large amount of toner and is not proper as the paper to be used in white paper cleaning, even though the remaining paper with the transferred toner image passes through the fixing device 14, it is not counted as the number of the papers subjected to the white paper cleaning.

The CPU 111 repeats steps S704 to S706 for each remaining paper until the automatic purge is completed (S707: NO).

When the automatic purge has been completed (S707: YES), the CPU 111 performs a process of step S708. Specifically, the CPU 111 subtracts the number of the papers having passed through the fixing device 14 for the white paper cleaning and counted in step S706 from the default value set as the number of the papers required to pass through the fixing device in the white paper cleaning. Then, the CPU 111 displays the number of papers after the subtraction on a screen, which is used for performing the white paper cleaning after the automatic purge, of the display unit 115 as the number of the papers set for the white paper cleaning after the automatic purge.

Figure 10:
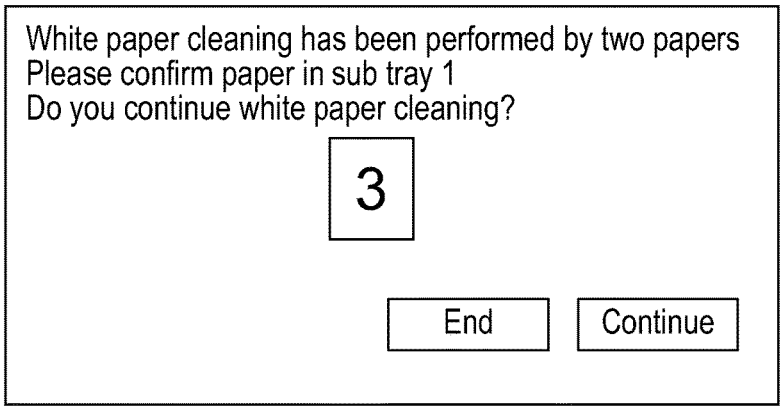
FIG. 10 is a diagram illustrating an example of a screen for performing the white paper cleaning after the automatic purge.
Figure 12:
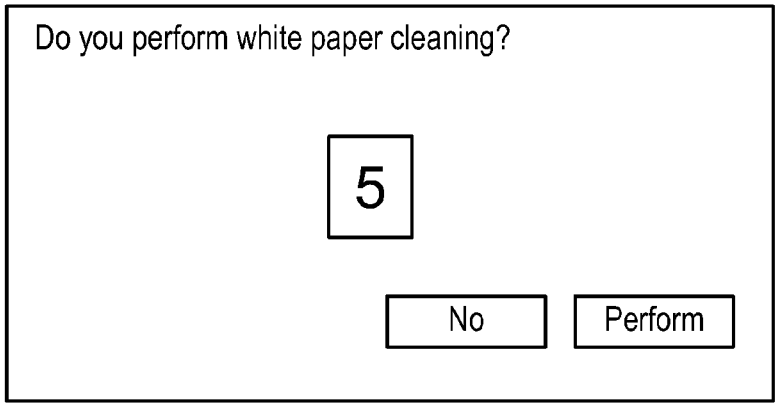
FIG. 12 is a diagram illustrating an example of a conventional screen for performing the white paper cleaning after the automatic purge.
Figure 13:
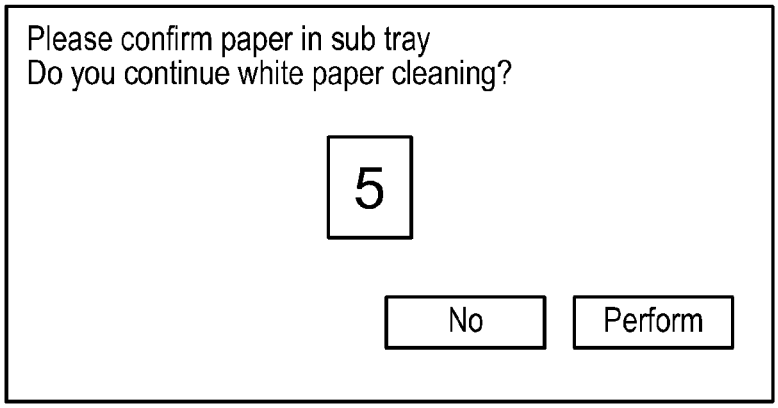
FIG. 13 is a diagram illustrating an example of a conventional screen for continuing the white paper cleaning after the automatic purge.

FIG. 10 is a diagram illustrating an example of the screen for performing the white paper cleaning after the automatic purge in the present embodiment. FIG. 12 is a diagram illustrating an example of a conventional screen for performing the white paper cleaning after the automatic purge. FIG. 13 is a diagram illustrating an example of a conventional screen for continuing the white paper cleaning after the automatic purge.

With reference to FIG. 12 and FIG. 13, the examples of the conventional screen for performing and continuing the white paper cleaning after the automatic purge will be described.

As illustrated in FIG. 12, conventionally, after the jam occurs, the originating paper is removed, and the automatic purge of the remaining papers other than the originating paper is performed, a screen is displayed to prompt the user to determine the necessity of the white paper cleaning by the default value "5" of the number of papers. Accordingly, for example, even though the white paper cleaning in the automatic purge has been performed, since the number of the remaining papers used in the white paper cleaning in the automatic purge is not considered and the determination for the necessity of the white paper cleaning by the default value of the number of the papers is indiscriminately prompted, the number of the papers to be used in the white paper cleaning is not optimized and the waste of papers occurs.

Furthermore, as illustrated in FIG. 13, after the white paper cleaning by the default value of the number of the papers ends, both confirmation for the papers used in the white paper cleaning and discharged and display for prompting the determination for continuation of the white paper cleaning after the confirmation are provided. Accordingly, for example, when the white paper cleaning in the automatic purge is not performed, since it is not possible to confirm the degree of pollution of the papers used in the white paper cleaning at the end of the automatic purge, it is further probable that the waste of the papers occurs.

On the other hand, as illustrated in FIG. 10, in the present embodiment, on the screen for performing the white paper cleaning after the automatic purge, the number "3" of the papers, which is obtained by subtracting the number "2" of the papers having passed through the fixing device 14 for the white paper cleaning in the automatic purge from the default value "5", is displayed as the number of the papers set for the white paper cleaning after the automatic purge. Furthermore, a sentence "please confirm papers in sub-tray 1" is displayed, so that display for prompting the confirmation of the papers discharged by the automatic purge is provided. The user can confirm the degree of pollution of remaining papers used in the white paper cleaning in the automatic purge and discharged in the sub-tray 1 according to the display, and then determine the necessity of the white paper cleaning after the automatic purge. That is, when the pollution of the remaining papers discharged in the sub-tray 1 is not substantially confirmed, the user selects a button "End" on the present screen, so that it is possible to complete the white paper cleaning by the number of papers smaller than the default value.

Furthermore, when the pollution of the remaining papers discharged in the sub-tray 1 is confirmed, the user selects a button "Continue" on the present screen, so that it is possible to perform the white paper cleaning after the automatic purge in the number of the papers obtained by subtracting the number of the remaining papers used in the white paper cleaning in the automatic purge from the default value. In this way, the number of the papers to be used in the white paper cleaning after the automatic purge is optimized in response to the number of the remaining papers at the time of the occurrence of the jam, so that it is possible to prevent the waste of the papers.

In addition, the user estimates the number of papers required in the white paper cleaning after the automatic purge in response to the degree of the pollution of the remaining papers discharged in the sub-tray 1 after the white paper cleaning in the automatic purge is performed, and feeds the estimated number of the papers to the image forming apparatus 110 so as to pass through the fixing device 14, so that it is also possible to perform the white paper cleaning after the automatic purge. In the white paper cleaning, except that the image formation is not performed and the blank paper is fed, processes, in which the papers are conveyed to the conveyance path and are heated, pressed or the like by the fixing device 14, are performed in the same way as normal times. Accordingly, the user inputs the number of the papers and a print instruction to the image forming apparatus 110, so that it is possible to perform the white paper cleaning by the input number of the papers. In this way, it is possible to confirm the number of papers in the white paper cleaning after the automatic purge after confirming the degree of pollution of the remaining papers discharged in the sub-tray, so that it is possible to further prevent the waste of the papers.

When the number of the papers having passed through the fixing device 14 for the white paper cleaning in the automatic purge has exceeded the default value, the number of the papers obtained by subtracting the number of the papers having passed through the fixing device 14 for the white paper cleaning in the automatic purge from the default value may not be displayed on the display unit 115. In this way, at the time of the automatic purge, the execution of the white paper cleaning by at least the default value of the number of papers is guaranteed, so that the user can be released from complication aware of the white paper cleaning.

Figure 11:
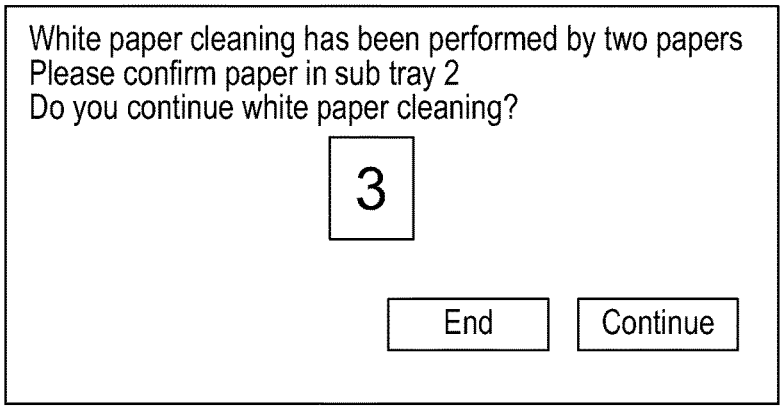
FIG. 11 is a diagram illustrating another example of a screen for performing the white paper cleaning after the automatic purge.

FIG. 11 is a diagram illustrating another example of the screen for performing the white paper cleaning after the automatic purge.

The screen of FIG. 11 is the screen for performing the white paper cleaning after the automatic purge when only the paper having passed through the fixing device 14 without being subjected to image transfer among the papers having passed through the fixing device 14 for the white paper cleaning in the automatic purge, is discharged in dedicated sub-tray 2. Accordingly, on the present screen, a sentence "please confirm papers of sub-tray 2" is displayed, so that display for prompting the confirmation of the papers discharged in the sub-tray 2 by the automatic purge is provided.

Since the remaining papers discharged by the automatic purge are basically discharged in the sub-tray 1, both remaining papers having passed through the fixing device 14 after being subjected to the image transfer and remaining papers having passed through the fixing device 14 without being subjected to the image transfer are discharged in the sub-tray 1. However, since image formation based on image data has been performed on the remaining papers having passed through the fixing device 14 after being subjected to the image transfer, it is difficult and improper to determine the necessity of the white paper cleaning after the automatic purge and the number of papers, which are to be used in the white paper cleaning after the automatic purge, by the degree of pollution of the remaining papers.

In this regard, among the papers having passed through the fixing device 14 for the white paper cleaning in the automatic purge, only the paper having passed through the fixing device 14 without being subjected to the image transfer is discharged in the dedicated sub-tray 2, so that it is possible to easily determine the necessity of the white paper cleaning after the automatic purge and the number of the papers to be used in the white paper cleaning after the automatic purge.

The present embodiment has the following effects.

After the automatic purge ends, the number of the remaining papers used in the white paper cleaning in the automatic purge is subtracted from the default value set in advance as the number of the papers by which white paper cleaning is performed, and the number of the papers after the subtraction is displayed as the number of the papers set for the white paper cleaning after the automatic purge. In this way, the number of the papers to be used in the white paper cleaning after the automatic purge is optimized in response to the number of the remaining papers at the time of the occurrence of the jam, so that it is possible to prevent the waste of the papers. Furthermore, after the degree of pollution of papers used in the white paper cleaning in the automatic purge and discharged is confirmed, it is possible to determine the necessity of the white paper cleaning after the automatic purge and the number of the papers to be used in additional white paper cleaning, so that it is possible to further improve the effect of preventing the waste of the papers.

Moreover, the number of the papers, which is obtained by excluding the number of the papers having passed through the fixing device after being subjected to toner image transfer from the number of the papers having passed through the fixing device for the white paper cleaning in the automatic purge, is subtracted from the default value, and the number of the papers after the subtraction is displayed as the number of the papers set for the white paper cleaning after the automatic purge. In this way, the transferred papers not proper as the papers to be used in the white paper cleaning are not considered as the papers used in the white paper cleaning in the automatic purge, so that it is possible to further optimize the number of the papers to be used in the white paper cleaning after the automatic purge.

Moreover, display for prompting confirmation for the papers used in and discharged after the white paper cleaning in the automatic purge is provided. In this way, the degree of pollution of the papers used in the white paper cleaning in the automatic purge is more reliably confirmed by the user, so that it is possible to further improve the effect of preventing the waste of the papers.

Moreover, when the number of the papers having passed through the fixing device for the white paper cleaning in the automatic purge has exceeded the default value, the number of the papers obtained by subtracting the number of the papers having passed through the fixing device for the white paper cleaning in the automatic purge from the default value is not displayed. In this way, at the time of the automatic purge, the execution of the white paper cleaning by at least the default value of the number of the papers is guaranteed, so that the user can be released from complication aware of the white paper cleaning.

Moreover, among the papers having passed through the fixing device for the white paper cleaning in the automatic purge, only the paper having passed through the fixing device without being image transfer is discharged to the dedicated tray. In this way, it is possible to easily determine the necessity of the white paper cleaning after the automatic purge and the number of the papers to be used in the white paper cleaning after the automatic purge.

The image forming apparatus and the image forming system according to the present invention are not limited to the aforementioned embodiment.

For example, in the case in which the post-processing device is not provided and the image forming apparatus performs only the image forming process by itself, when the paper jam has occurred in the image forming apparatus, the remaining papers used in the white paper cleaning in the automatic purge may be discharged from the image forming apparatus, and after the automatic purge ends, the number of the papers, which is obtained by subtracting the number of remaining papers used in the white paper cleaning in the automatic purge from the default value set as the number of papers by which white paper cleaning is performed, may be displayed.

Furthermore, in the aforementioned embodiment, the process of the white paper cleaning performed at the time of the automatic purge is performed by the program. However, the whole or a part of the process performed by the program may be performed by hardware such as a circuit.

What is claimed is:

1. An image forming apparatus comprising:

a hardware processor which performs functions comprising:

conducting an automatic purge of conveying and discharging a total number of remaining papers to perform white paper cleaning by making the total number of remaining papers pass through a fixing device after an originating paper having caused a jam is removed when said jam has occurred in a paper conveyance path;

excluding from the total number of remaining papers, those papers which are from among the total number of remaining papers and which have already been subjected to image transfer on at least one side thereof, so as to obtain a first number of papers, wherein the first number of papers is a number of papers which have passed through said fixing device during said white paper cleaning and which have not been subjected to image transfer on either side, among said total number of remaining papers, and wherein the first number of papers does not include those papers which are from among the total number of remaining papers and which have already been subjected to image transfer on at least one side thereof;

subtracting the first number of papers from a set number of papers set in advance as a number of papers required to pass through said fixing device in said white paper cleaning, so as to obtain a second number of papers; and after said automatic purge, making said second number of papers pass through said fixing device for said white paper cleaning.

2. The image forming apparatus as claimed in claim 1, wherein the functions performed by the hardware processor further comprise discharging, to a dedicated tray, only said first number of papers which have passed through said fixing device and which have not been subjected to image transfer among said total number of remaining papers having passed through said fixing device for said white paper cleaning in said automatic purge.

3. An image forming system comprising:

an image forming apparatus;

a post processing device; and a hardware processor which performs functions comprising:

conducting an automatic purge of conveying and discharging a total number of remaining papers to perform white paper cleaning by making the total number of remaining papers pass through a fixing device after an originating paper having caused a jam is removed when said jam has occurred in a paper conveyance path of said image forming apparatus or said post processing device;

excluding from the total number of remaining papers, those papers which are from among the total number of remaining papers and which have already been subjected to image transfer on at least one side thereof, so as to obtain a first number of papers, wherein the first number of papers is a number of papers which have passed through said fixing device during said white paper cleaning and which have not been subjected to image transfer on either side, among said total number of remaining papers, and wherein the first number of papers does not include those papers which are from among the total number of remaining papers and which have already been subjected to image transfer on at least one side thereof;

subtracting the first number of papers from a set number of papers set in advance as a number of papers required to pass through said fixing device in said white paper cleaning, so as to obtain a second number of papers; and after said automatic purge, making said second number of papers pass through said fixing device for said white paper cleaning.

4. The image forming system as claimed in claim 3, wherein the functions performed by said hardware processor further comprise discharging, to a dedicated tray, only said first number of papers which have passed through said fixing device and which have not been subjected to image transfer among said total number of remaining papers having passed through said fixing device for said white paper cleaning in said automatic purge.

5. The image forming apparatus as claimed in claim 1, further comprising:

a display;

wherein the functions performed by said hardware processor further comprise displaying, on the display, the second number of papers obtained by said subtracting, as a number of papers set for said white paper cleaning after said automatic purge.

6. The image forming apparatus as claimed in claim 5, wherein the functions performed by said hardware processor further comprise displaying, on the display, a prompt for confirming for a paper discharged by said automatic purge.

7. The image forming apparatus as claimed in claim 5, wherein the functions performed by said hardware processor further comprise, when the first number of papers exceeds said set number of papers, performing control so as not to display the second number of papers obtained by said subtracting.

8. The image forming apparatus as claimed in claim 1, wherein the second number of papers, which said hardware processor makes pass through said fixing device for said white paper cleaning after said automatic purge, are papers other than the total number of remaining papers.

9. The image forming apparatus as claimed in claim 5, wherein the functions performed by said hardware processor further comprise displaying, on the display, a prompt for confirming at least one of a position of a paper discharged by said automatic purge and pollution of the paper discharged by said automatic purge.

10. The image forming system as claimed in claim 3, further comprising:

a display;

wherein the functions performed by said hardware processor further comprise displaying, on the display, the second number of papers obtained by said subtracting, as a number of papers set for said white paper cleaning after said automatic purge.

11. The image forming system as claimed in claim 10, wherein the functions performed by said hardware processor further comprise displaying, on the display, a prompt for confirming for a paper discharged by said automatic purge.

12. The image forming system as claimed in claim 10, wherein the functions performed by said hardware processor further comprise, when the first number of papers exceeds said set number of papers, performing control so as not to display the second number of papers obtained by said subtracting.

13. The image forming system as claimed in claim 3, wherein the second number of papers, which said hardware processor makes pass through said fixing device for said white paper cleaning after said automatic purge, are papers other than the total number of remaining papers.

14. The image forming system as claimed in claim 10, wherein the functions performed by said hardware processor further comprise displaying, on the display, a prompt for confirming at least one of a position of a paper discharged by said automatic purge and pollution of the paper discharged by said automatic purge.

* * * * *